US012077905B2

(12) United States Patent
Nishigawa et al.

(10) Patent No.: US 12,077,905 B2
(45) Date of Patent: Sep. 3, 2024

(54) ELASTIC FIBER PROCESSING AGENT AND ELASTIC FIBER

(71) Applicant: TAKEMOTO YUSHI KABUSHIKI KAISHA, Gamagori (JP)

(72) Inventors: Takeshi Nishigawa, Gamagori (JP); Keiichiro Oshima, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 18/043,769

(22) PCT Filed: Sep. 6, 2021

(86) PCT No.: PCT/JP2021/032669

§ 371 (c)(1),
(2) Date: Mar. 2, 2023

(87) PCT Pub. No.: WO2022/050409

PCT Pub. Date: Mar. 10, 2022

(65) Prior Publication Data

US 2023/0243090 A1 Aug. 3, 2023

(30) Foreign Application Priority Data

Sep. 7, 2020 (JP) ..... 2020-149964

(51) Int. Cl.

| | |
|---|---|
| ***D06M 13/02*** | (2006.01) |
| ***D06M 13/144*** | (2006.01) |
| ***D06M 13/256*** | (2006.01) |
| ***D06M 13/292*** | (2006.01) |
| ***D06M 15/643*** | (2006.01) |
| ***D06M 101/38*** | (2006.01) |

(52) U.S. Cl.

CPC ..... *D06M 13/02* (2013.01); *D06M 13/144* (2013.01); *D06M 13/256* (2013.01); *D06M 13/292* (2013.01); *D06M 15/643* (2013.01); *D06M 2101/38* (2013.01); *D06M 2200/40* (2013.01)

(58) Field of Classification Search

CPC ..... D06M 13/02

See application file for complete search history.

(56) References Cited

U.S. PATENT DOCUMENTS

2020/0199474 A1* 6/2020 Hill, Jr. ..... C09J 11/06

FOREIGN PATENT DOCUMENTS

| | | | | |
|---|---|---|---|---|
| JP | 2005325497 | A | | 11/2005 |
| JP | 5393906 | B | | 1/2014 |
| JP | 2014156664 | A | | 8/2014 |
| JP | 6125739 | B1 | | 5/2017 |
| JP | 2017110319 | A | | 6/2017 |
| JP | 2017203222 | A | | 11/2017 |
| JP | 6328866 | B1 | * | 5/2018 |
| JP | 2018159163 | A | * | 10/2018 |
| JP | 2018199875 | A | | 12/2018 |
| JP | 6480072 | B1 | | 3/2019 |
| WO | 2015125753 | A | | 8/2015 |

OTHER PUBLICATIONS

Nakagawa et al. English machine translation of JP 2018159163 A. (Year: 2018).*

Nishikawa et al. English machine translation of JP 6328866 B1. (Year: 2018).*

International Search Report for Application No. PCT/JP2021/032669 mailed on Oct. 19, 2021.

Office action in Korean Patent Application No. 10-2023-7010004, Filing Date: Mar. 23, 2023, Date of Mailing Apr. 27, 2023, 13 pages.

* cited by examiner

*Primary Examiner* — Peter F Godenschwager

(74) *Attorney, Agent, or Firm* — CANTOR COLBURN LLP

(57) ABSTRACT

An elastic fiber treatment agent that contains, as a smoothing agent, a mineral oil with a content ratio of an aromatic component of less than 1% by mass and an aniline point of 70° C. to 110° C. The mineral oil has a mass ratio between the content of a naphthene component and the content of a paraffin component of such that naphthene component/paraffin component=30 to 50/70 to 50.

13 Claims, No Drawings

ELASTIC FIBER PROCESSING AGENT AND ELASTIC FIBER

TECHNICAL FIELD

The present invention relates to an elastic fiber treatment agent that contains a specific mineral oil as a smoothing agent and to an elastic fiber to which the elastic fiber treatment agent is adhered.

BACKGROUND ART

Elastic fibers, such as polyurethane elastic fibers, are strong in stickiness between the fibers in comparison to other synthetic fibers. Therefore, there is a problem in that when after elastic fibers are spun and wound into a package, the fibers are drawn out from the package to be subject to a processing step, it is difficult to unwind the fibers stably from the package. Thus, an elastic fiber treatment agent that contains a smoothing agent such as a hydrocarbon oil may be used to improve the smoothness of the elastic fibers.

Elastic fiber treatment agents as disclosed in Patent Documents 1 and 2 are previously known. Patent Document 1 discloses an elastic fiber treatment agent that contains a hydrocarbon oil and at least one selected from the group consisting of ester oils, higher alcohols, polyhydric alcohols, organic phosphoric acid esters, organic amines, metal soaps, organopolysiloxane resins, nonionic surfactants, cationic surfactants, and anionic surfactants. Patent Document 2 discloses an elastic fiber treatment agent that contains a mineral oil with a content of an aromatic component being less than 1% and a content of a naphthene component being 10% to 30% and has a kinematic viscosity at 30° C. within a predetermined range.

CITATION LIST

Patent Literature

Patent Document 1: Japanese Laid-Open Patent Publication No. 2017-110319

Patent Document 2: Japanese Patent No. 5393906

SUMMARY OF INVENTION

Technical Problem

However, there has been a demand for further improvement in shape characteristics when an elastic fiber to which the elastic fiber treatment agent is applied is wound into a predetermined shape.

A problem to be solved by the present invention is to provide an elastic fiber treatment agent that is capable of improving shape characteristics of an elastic fiber and an elastic fiber to which the elastic fiber treatment agent is adhered.

Solution to Problem

As a result of performing research toward solving the above problem, the inventors of the present application have found that an elastic fiber treatment agent is suitable in which a mineral oil with a content of an aromatic component and an aniline point within predetermined ranges is blended.

To solve the above problem and in accordance with one aspect of the present invention, an elastic fiber treatment agent is characterized by containing, as a smoothing agent, a mineral oil with a content ratio of an aromatic component of less than 1% by mass and an aniline point of 70° C. to 110° C. and in that the mineral oil has a mass ratio between the content of a naphthene component and the content of a paraffin component of such that naphthene component/paraffin component=30 to 50/70 to 50.

The elastic fiber treatment agent preferably further contains a dialkyl sulfosuccinic acid salt.

The elastic fiber treatment agent preferably further contains at least one hydroxy compound selected from the group consisting of higher alcohols and alkylene oxide adducts of higher alcohols.

In the elastic fiber treatment agent, the higher alcohol preferably includes a monohydric aliphatic alcohol having a branched chain at a β-position of an alkyl chain with 10 to 20 carbon atoms.

The elastic fiber treatment agent preferably further contains an alkyl phosphoric acid ester salt.

In the elastic fiber treatment agent, the alkyl phosphoric acid ester salt is preferably a magnesium salt of an alkyl phosphoric acid ester.

In the elastic fiber treatment agent, the content ratio of the mineral oil in the treatment agent is preferably not less than 10% by mass.

To solve the above problem and in accordance with another aspect of the present invention, an elastic fiber is characterized in that the elastic fiber treatment agent is adhered thereto.

Advantageous Effects of Invention

The present invention succeeds in improving shape characteristics of an elastic fiber.

DESCRIPTION OF EMBODIMENTS

First Embodiment

A first embodiment in which an elastic fiber treatment agent (also referred to hereinafter as treatment agent) of the present invention is embodied will now be described. The treatment agent of the present embodiment contains a smoothing agent and may further contain a dialkyl sulfosuccinic acid salt, a hydroxy compound, and/or an alkyl phosphoric acid ester salt.

The smoothing agent used in the treatment agent of the present embodiment contains a specific mineral oil. The smoothing agent is blended in the treatment agent as a base ingredient and imparts smoothness to an elastic fiber.

Examples of the mineral oil include a general petroleum distillate constituted of a paraffin component, a naphthene component, and an aromatic component. Respective qualitative and content analyses of the aromatic component, the naphthene component, and the paraffin component in the mineral oil are performed in a ring analysis by an n-d-M method defined in ASTM D3238 and the contents of the aromatic component, the naphthene component, and the paraffin component are the same in meaning as values of % $C_A$, % $C_N$, and % $C_P$ indicated therein.

The content ratio of the aromatic component in the mineral oil is, for example, less than 3% by mass or less than 2% by mass. In the present embodiment, it is less than 1% by mass. By specifying the range to be less than 3% by mass, respective effects of suppression of yarn yellowing, swelling preventing property, shape characteristics, antistatic property, scum suppression, and unwinding property are improved in particular. Also, by specifying the range to be less than 1% by mass, the effect of suppression of yarn yellowing is improved further in particular.

The aniline point of the mineral oil is 70° C. to 110° C. By specifying to be in such range, respective effects of shape characteristics and cob-webbing preventing property are improved in particular. The aniline point is measured in accordance with JIS K 2256. JIS K 2256 corresponds to the international standard ISO 2977:1977.

The mass ratio between the content of the naphthene component and the content of the paraffin component in the mineral oil is set as appropriate and in the present embodiment, is such that naphthene component/paraffin component=30 to 50/70 to 50. By specifying to be in such range, the shape characteristics are improved further in particular.

The mineral oil may be prepared, for example, by combining an aromatic hydrocarbon, a paraffin hydrocarbon, and a naphthene hydrocarbon as appropriate. Also, a commercial product within the above parameter ranges may be used as appropriate.

The content of the mineral oil in the treatment agent is set as appropriate and preferably not less than 10% by mass. By specifying to be in such range, the effects of the present invention are improved further. The content of the mineral oil in the treatment agent is determined from a mass of absolutely dry matter obtained by heat treating the treatment agent at 105° C. for 2 hours to sufficiently remove volatile matter. Hereinafter, the contents of respective ingredients in the treatment agent are determined by the same method.

As the smoothing agent used in the present embodiment, a smoothing agent other than those mentioned above may be used in combination. As the smoothing agent other than the above ones, a known smoothing agent may be used as appropriate. Examples of the smoothing agent other than the above ones include a silicone oil, a polyolefin, and an ester oil.

Specific examples of the silicone oil include dimethyl silicones, phenyl-modified silicones, amino-modified silicones, amide-modified silicones, polyether-modified silicones, aminopolyether-modified silicones, alkyl-modified silicones, alkylaralkyl-modified silicones, alkylpolyether-modified silicones, ester-modified silicones, epoxy-modified silicones, carbinol-modified silicones, mercapto-modified silicones, and polyoxyalkylene-modified silicones. As the silicone oil, a commercially available product may be used as appropriate.

As the polyolefin, a poly-α-olefin used as a smoothing ingredient is used. Specific examples of the polyolefin include poly-α-olefins obtained by polymerizing, for example, 1-butene, 1-hexene, or 1-decene. As the poly-α-olefin, a commercially available product may be used as appropriate.

The ester oil is not limited in particular, and examples thereof include an ester oil produced from a fatty acid and an alcohol. The ester oil is, for example, an ester oil produced from a fatty acid having an odd or even number of hydrocarbon groups and an alcohol, which will be described later.

The fatty acid that is a raw material of the ester oil is not limited in particular in regard to, for example, the number of carbon atoms, whether or not it is branched, or valence, and it may be, for example, a higher fatty acid, a fatty acid having a cyclo ring, or a fatty acid having an aromatic ring. The alcohol that is a raw material of the ester oil is not limited in particular in regard to, for example, the number of carbon atoms, whether or not it is branched, or valence, and it may be, for example, a higher alcohol, an alcohol having a cyclo ring, or an alcohol having an aromatic ring.

Specific examples of the ester oil include (1) ester compounds of an aliphatic monoalcohol and an aliphatic monocarboxylic acid, such as octyl palmitate, oleyl laurate, oleyl oleate, isotridecyl stearate, and isotetracosyl oleate, (2) ester compounds of an aliphatic polyhydric alcohol and an aliphatic monocarboxylic acid, such as 1,6-hexanediol didecanoate, glycerin trioleate, trimethylolpropane trilaurate, and pentaerythritol tetraoctanoate, (3) ester compounds of an aliphatic monoalcohol and an aliphatic polycarboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate, benzyl laurate, (5) complete ester compounds of an aromatic polyhydric alcohol and an aliphatic monocarboxylic acid, such as bisphenol A dilaurate, (6) complete ester compounds of an aliphatic monoalcohol and an aromatic polycarboxylic acid, such as bis-2-ethylhexylphthalate, diisostearyl isophthalate, and trioctyl trimellitate, and (7) natural oils and fats, such as coconut oil, rapeseed oil, sunflower oil, soybean oil, castor oil, sesame oil, fish oil, and beef tallow.

With the smoothing agent, one type of smoothing agent may be used alone, or two or more types of smoothing agents may be used in appropriate combination.

The treatment agent of the present embodiment may contain a dialkyl sulfosuccinic acid salt. The dialkyl sulfosuccinic acid salt further improves an antistatic property. Specific examples of the dialkyl sulfosuccinic acid salt are not restricted in particular, but those having an alkyl group with 8 to 16 carbon atoms are preferable. Examples of the salt include alkali metal salts, such as sodium salts and potassium salts, alkaline earth metal salts, ammonium salts, and organic amine salts, such as alkanolamines. Specific examples of the dialkyl sulfosuccinic acid salt include sodium dioctyl sulfosuccinate, magnesium dioctyl sulfosuccinate, dioctyl sulfosuccinic acid triethanolamine salt, sodium didecyl sulfosuccinate, sodium didodecyl sulfosuccinate (sodium dilauryl sulfosuccinate), magnesium didodecyl sulfosuccinate, lithium ditetradecyl sulfosuccinate, and potassium dihexadecyl sulfosuccinate. With the dialkyl sulfosuccinic acid salt, one type of dialkyl sulfosuccinic acid salt may be used alone, or two or more types of dialkyl sulfosuccinic acid salts may be used in appropriate combination.

The content of the dialkyl sulfosuccinic acid salt in the treatment agent is set as appropriate and preferably 0.05% to 10% by mass. By specifying to be in such range, the antistatic property is improved further.

The treatment agent of the present embodiment may contain at least one hydroxy compound selected from the group consisting of higher alcohols and alkylene oxide adducts of higher alcohols. By blending such a hydroxy compound, scum can be reduced further.

The higher alcohols are monohydric alcohols having a hydrocarbon group with a large number of carbon atoms. The number of carbon atoms of each higher alcohol is preferably not less than 6, more preferably 6 to 22, and even more preferably 10 to 20. The higher alcohol is not limited in particular in terms of the presence or absence of an unsaturated bond, and may be an alcohol having a linear or branched hydrocarbon group, an alcohol having a cyclo ring, or an alcohol having an aromatic ring. In the case of an alcohol having a branched hydrocarbon group, the branching position is not limited in particular. For example, the hydrocarbon group may have a carbon chain branched at an α-position or a carbon chain branched at β-position. The alcohol may be a primary alcohol or a secondary alcohol.

Among the above, a Guerbet alcohol, that is, a monohydric aliphatic alcohol having a branched chain at the β-position of an alkyl chain is preferable, a Guerbet alcohol with 6 to 22 carbon atoms is more preferable, and a Guerbet alcohol with 10 to 20 carbon atoms is even more preferable.

Specific examples of the Guerbet alcohol include 2-ethyl-1-propanol, 2-ethyl butanol, 2-ethyl-1-hexanol, 2-ethyl-1-octanol, 2-ethyl-decanol, 2-butyl-1-hexanol, 2-butyl octanol, 2-butyl-1-decanol, 2-hexyl-1-octanol, 2-hexyl-1-decanol, 2-octyl-1-decanol, 2-octyl-1-dodecanol, 2-hexyl-1-octanol, 2-hexyl-1-dodecanol, 2-(1,3,3-trimethylbutyl)-5,7,7-trimethyl-1-octanol, 2-(4-methylhexyl)-8-methyl-1-decanol, and 2-(1,5-dimethylhexyl)-5,9-dimethyl-1-decanol.

Specific examples of the higher alcohol other than those mentioned above include stearyl alcohol and 2-dodecanol.

If a compound in which an alkylene oxide is added is used, specific examples of the alkylene oxide include alkylene oxides with 2 to 4 carbon atoms, such as ethylene oxide, propylene oxide, and butylene oxide. The number of added moles of the alkylene oxide with respect to 1 mole of the higher alcohol is preferably 1 to 50 moles, more preferably 1 to 30 moles, and even more preferably 1 to 10 moles.

With the hydroxy compound, one type of hydroxy compound may be used alone, or two or more types of hydroxy compounds may be used in appropriate combination.

The content of the hydroxy compound in the treatment agent is set as appropriate and preferably 0.05% to 10% by mass. By specifying to be in such range, scum is reduced further.

The treatment agent of the present embodiment may contain an alkyl phosphoric acid ester salt. By blending the alkyl phosphoric acid ester salt, the cob-webbing preventing effect and the unwinding property can be improved further.

An alkyl group that constitutes the alkyl phosphoric acid ester salt is not limited in particular, and example thereof include an alkyl group of straight chain form or a branched alkyl group. Among these, a branched alkyl group is preferable from a standpoint of further improving the cob-webbing preventing effect and the unwinding property. The branching position in the branched alkyl group is not limited in particular. For example, the alkyl group may be branched at a α-position or a β-position.

The number of carbon atoms of the alkyl group is not restricted in particular, and the number of carbon atoms is preferably 1 to 32 and more preferably 8 to 32. Specific examples of the alkyl group include a methyl group, an ethyl group, a propyl group, a butyl group, a pentyl group, a hexyl group, a heptyl group, an octyl group, a decyl group, an undecyl group, a dodecyl group, a tridecyl group, a tetradecyl group, a pentadecyl group, a hexadecyl group, a heptadecyl group, an octadecyl group, an icosyl group, an isopropyl group, an isobutyl group, an isopentyl group, an isohexyl group, an isoheptyl group, an isooctyl group, an isodecyl group, an isoundecyl group, an isododecyl group, an isotridecyl group, an isotetradecyl group, an isopentadecyl group, an isohexadecyl group, an isoheptadecyl group, an isooctadecyl group, and an isoicosyl group.

A phosphoric acid that constitutes the alkyl phosphoric acid ester salt is not limited in particular, and may be orthophosphoric acid or a polyphosphoric acid, such as diphosphoric acid.

Examples of a salt that constitutes the alkyl phosphoric acid ester salt include an amine salt and a metal salt.

An amine that constitutes the amine salt may be any of primary amines, secondary amines, and tertiary amines. Specific examples of an amine that constitutes the amine salt include (1) aliphatic amines, such as methylamine, dimethylamine, trimethylamine, ethylamine, diethylamine, triethylamine, N—N-diisopropylethylamine, butylamine, dibutylamine, 2-methylbutylamine, tributylamine, octylamine, and dimethyllaurylamine, (2) aromatic amines or heterocyclic amines, such as aniline, N-methylbenzylamine, pyridine, morpholine, piperazine, and derivatives of the above, (3) alkanolamines, such as monoethanolamine, N-methylethanolamine, diethanolamine, triethanolamine, isopropanolamine, diisopropanolamine, triisopropanolamine, dibutylethanolamine, butyldiethanolamine, octyldiethanolamine, and lauryldiethanolamine, (4) aryl amines, such as N-methylbenzylamine, (5) polyoxyalkylene alkyl aminoethers, such as polyoxyethylene lauryl aminoethers and polyoxyethylene stearyl aminoethers, and (6) ammonia.

Examples of the metal salt include an alkali metal salt and an alkaline earth metal salt. Specific examples of an alkali metal that constitutes the alkali metal salt include sodium, potassium, and lithium. Examples of an alkaline earth metal that constitutes the alkaline earth metal salt include a metal corresponding to being a group 2 element, such as calcium, magnesium, beryllium, strontium, and barium. Among these, a magnesium salt of an alky phosphoric acid ester is preferable from a standpoint of further improving the unwinding property.

Specific examples of the alkyl phosphoric acid ester salt include a magnesium salt of 2-octyl-1-dodecyl phosphoric acid ester, a magnesium salt of 2-hexyl-1-decyl phosphoric acid ester, and a dibutylethanolamine salt of 2-octyl-1-dodecyl phosphoric acid ester.

With the alkyl phosphoric acid ester salt, one type of alkyl phosphoric acid ester salt may be used alone or two or more types of alkyl phosphoric acid ester salts may be used in combination.

The content of the alkyl phosphoric acid ester salt in the treatment agent is set as appropriate and preferably 0.05% to 10% by mass. By specifying to be in such range, the cob-webbing preventing effect and the unwinding property can be improved further.

Second Embodiment

Next, a second embodiment in which an elastic fiber according to the present invention is embodied will be described. The treatment agent of the first embodiment is adhered to an elastic fiber of the present embodiment. The amount of the treatment agent of the first embodiment (not including a solvent) adhered to the elastic fibers is not limited in particular, and the treatment agent is adhered at a proportion of preferably 0.1% to 10% by mass from a standpoint of improving the effects of the present invention further.

The elastic fibers is not limited in particular, and example thereof include polyester elastic fibers, polyamide elastic fibers, polyolefin elastic fibers, and polyurethane elastic fibers. Among these, polyurethane elastic fibers are preferable. In this case, higher expression of the effects of the present invention can be achieved.

The method for manufacturing the elastic fiber of the present invention includes feeding the treatment agent of the first embodiment to elastic fiber. As a method for feeding the treatment agent, a method of adhering the treatment agent to the elastic fiber in a step of spinning the elastic fiber by a neat feeding method without dilution is preferable. As an adhesion method, for example, a known method such as a roller lubrication method, a guide lubrication method, or a spray lubrication method can be used. In general, a lubrication roller is ordinarily positioned at a point between a spinneret and a winding traverse, and can also be applied to the manufacturing method of the present embodiment. Among the above, it is preferable to adhere the treatment agent of the first embodiment to an elastic fiber, for example, a polyurethane elastic fiber by a lubrication roller positioned between stretching rollers because the effects are remarkably exhibited.

The method for manufacturing the elastic fiber itself applied to the present embodiment is not restricted in particular, and the elastic fiber can be manufactured by a known method. Example of the method include a wet spinning method, a melt spinning method, and a dry spinning method. Among these, a dry spinning method is preferable from a standpoint that quality and manufacturing efficiency of the elastic fiber are excellent.

The operation and effects of the treatment agent and the elastic fiber of the embodiments will now be described.

(1) The treatment agent of the embodiments contains, as a smoothing agent, a mineral oil with a content ratio of an aromatic component of less than 1% by mass and an aniline point of 70° C. to 110° C. An elastic fiber to which the treatment agent is applied are thus improved in shape characteristics, especially, shape characteristics when wound into a cheese shape. In addition, the effect of suppression of yarn yellowing, the swelling preventing property, the antistatic property, the scum suppression effect, the cob-webbing preventing effect, and the unwinding property of the elastic fiber to which the treatment agent is applied are improved.

The above-described embodiments may be modified as follows. The above-described embodiments and the following modifications can be implemented in combination with each other within a range that is not technically inconsistent.

The treatment agent of the above-described embodiments may further have blended therein a stabilizer, an antistatic agent, a binder, an antioxidant, an ultraviolet absorber, and other ingredients that are ordinarily used in a treatment agent for quality maintenance of the treatment agent within a range that does not impair the effects of the present invention.

EXAMPLES

Examples will now be given below to describe the features and effects of the present invention more specifically, but the present invention is not restricted to these examples. In the following description of working examples and comparative examples, "parts" means parts by mass, and "%" means % by mass.

Experimental Part 1 (Preparation of Elastic Fiber Treatment Agents)

Treatment agents used in the respective examples and respective comparative examples were prepared using respective ingredients indicated in Tables 1 and 2 by a preparation method described below.

50 parts (%) of a mineral oil (A-1) shown in Table 1 and 47 parts (%) of a dimethyl silicone (B-1) with a viscosity at 25° C. of 10 cst as smoothing oils, 1 part of sodium dilauryl sulfosuccinate (C-1), 1 part (%) 2-hexyl-1-decanol (D-1) as a hydroxy compound, and 1 part (%) of a magnesium salt of 2-octyl-1-dodecyl phosphoric acid ester were mixed well and made uniform to prepare a treatment agent of Example 1.

For each of Examples 2 to 19, Examples 24 to 27 and 29, Reference Examples 20 to 23, 28, and 30 to 39, and Comparative Examples 1 to 3, a treatment agent was prepared in the same manner as in Example 1 by mixing smoothing agents, a dialkyl sulfosuccinic acid salt, a hydroxy compound, and an alkyl phosphoric acid ester salt at proportions indicated in Table 2.

The aromatic component, the naphthene component, the paraffin component, and the mass ratio between the naphthene component and the paraffin component in regard to the components of the mineral oils used in each treatment agent and the aniline point and the viscosity at 30° C. are respectively indicated in the "Aromatic component" column, the "Naphthene component" column, the "Paraffin component" column, the "Mass ratio of naphthene component/paraffin component" column, the "Aniline point" column, and the "Viscosity (30° C.)" column of Table 1. The viscosity at 30° C. represents the value of kinematic viscosity of the mineral oil at 30° C. measured using a Cannon-Fenske viscometer.

The types of the respective ingredients of the smoothing agents, the dialkyl sulfosuccinic acid salt, the hydroxy compound and the alkyl phosphoric acid ester salt and ratios of the respective ingredients if the sum of the content ratios of the respective ingredients in the treatment agents of the respective examples is taken as 100% are respectively indicated in the "Smoothing agents" column, the "Dialkyl sulfosuccinic acid salt" column, the "Hydroxy compound" column, and the "Alkyl phosphoric acid ester salt" column of Table 2.

TABLE 1

| | Aromatic component (% by mass) | Naphthene component (% by mass) | Paraffin component (% by mass) | Mass ratio of naphthene component/paraffin component | Aniline point (° C.) | Viscosity (30° C.) ($mm^2/s$) |
|---|---|---|---|---|---|---|
| A-1 | 0.5 | 42.0 | 57.5 | 42.2/57.8 | 89 | 15.6 |
| A-2 | 0.2 | 32.0 | 67.8 | 32.1/67.9 | 106 | 23.1 |
| A-3 | 0.8 | 48.0 | 51.2 | 48.4/51.6 | 78 | 10.8 |
| A-4 | 0.7 | 23.0 | 76.3 | 23.2/76.8 | 109 | 24.4 |
| A-5 | 0.1 | 55.0 | 44.9 | 55.1/44.9 | 72 | 8.2 |
| A-6 | 1.9 | 38.0 | 60.1 | 38.7/61.3 | 101 | 20.9 |
| A-7 | 2.1 | 53.0 | 44.9 | 54.1/45.9 | 95 | 17.0 |
| ra-1 | 9.5 | 55.0 | 35.5 | 60.8/39.2 | 64 | 10.5 |
| ra-2 | 3.5 | 33.0 | 63.5 | 34.2/65.8 | 90 | 16.0 |
| ra-3 | 0.0 | 31.0 | 69.0 | 31.0/69.0 | 115 | 32.0 |

TABLE 2

| | Elastic fiber treatment agent | | | | | | | | | |
|---|---|---|---|---|---|---|---|---|---|---|
| | Smoothing agents | | | | | | | | | |
| | Mineral oil | | Other smoothing agent | | Dialkyl sulfosuccinic acid salt | | Hydroxy compound | | Alkyl phosphoric acid ester salt | |
| Category | Type | Ratio (% by mass) | Type | Ratio (% by mass) | Type | Ratio (% by mass) | Type | Ratio (% by mass) | Type | Ratio (% by mass) |
| Example 1 | A-1 | 50 | B-1 | 47 | C-1 | 1 | D-1 | 1 | E-1 | 1 |
| Example 2 | A-1 | 50 | B-1 | 47.8 | C-1 | 0.2 | D-1 | 1 | E-1 | 1 |
| Example 3 | A-1 | 50 | B-1 | 41 | C-1 | 7 | D-1 | 1 | E-1 | 1 |
| Example 4 | A-1 | 50 | B-1 | 47.8 | C-1 | 1 | D-1 | 0.2 | E-1 | 1 |
| Example 5 | A-1 | 50 | B-1 | 41 | C-1 | 1 | D-1 | 7 | E-1 | 1 |
| Example 6 | A-1 | 50 | B-1 | 47.8 | C-1 | 1 | D-1 | 1 | E-1 | 0.2 |
| Example 7 | A-1 | 50 | B-1 | 41 | C-1 | 1 | D-1 | 1 | E-1 | 7 |
| Example 8 | A-1 | 50 | B-1 | 41 | C-1 | 3 | D-1 | 3 | E-1 | 3 |
| Example 9 | A-1 | 20 | B-1 | 77 | C-1 | 1 | D-1 | 1 | E-1 | 1 |
| Example 10 | A-1 | 70 | B-1 | 27 | C-1 | 1 | D-1 | 1 | E-1 | 1 |
| Example 11 | A-1 | 50 | B-1 | 47 | C-1 | 1 | D-1 | 1 | E-2 | 1 |
| Example 12 | A-1 | 50 | B-1<br>B-2 | 47 | C-1 | 1 | D-1 | 1 | E-1 | 1 |
| Example 13 | A-2 | 50 | B-1 | 47 | C-1 | 1 | D-1 | 1 | E-1 | 1 |
| Example 14 | A-3 | 50 | B-1 | 47 | C-1 | 1 | D-1 | 1 | E-1 | 1 |
| Example 15 | A-1 | 50 | B-1 | 47 | C-1 | 1 | D-1 | 1 | E-1 | 1 |
| Example 16 | A-1 | 50 | B-1 | 47 | C-2 | 1 | D-1 | 1 | E-1 | 1 |
| Example 17 | A-1 | 50 | B-1 | 47 | C-1 | 1 | D-2 | 1 | E-1 | 1 |
| Example 18 | A-1 | 50 | B-1 | 47 | C-1 | 1 | D-3 | 1 | E-1 | 1 |
| Example 19 | A-1 | 50 | B-1 | 48 | C-1 | 1 | — | — | E-1 | 1 |
| Reference example 20 | A-4 | 50 | B-1 | 47 | C-1 | 1 | D-1 | 1 | E-1 | 1 |
| Reference example 21 | A-5 | 50 | B-1 | 47 | C-1 | 1 | D-1 | 1 | E-1 | 1 |
| Reference example 22 | A-6 | 50 | B-1 | 47 | C-1 | 1 | D-1 | 1 | E-1 | 1 |
| Reference example 23 | A-7 | 50 | B-1 | 47 | C-1 | 1 | D-1 | 1 | E-1 | 1 |
| Example 24 | A-1 | 50 | B-1 | 47 | C-1 | 1 | D-1 | 1 | E-3 | 1 |
| Example 25 | A-1 | 50 | B-1 | 48 | C-1 | 1 | D-1 | 1 | — | — |
| Example 26 | A-1 | 50 | B-1 | 48 | — | — | D-1 | 1 | E-1 | 1 |
| Example 27 | A-1 | 50 | B-1 | 49 | — | — | — | — | E-1 | 1 |
| Reference example 28 | A-4 | 50 | B-1 | 49 | — | — | — | — | E-1 | 1 |
| Example 29 | A-1 | 50 | B-1 | 50 | — | — | — | — | — | — |
| Reference example 30 | A-4 | 50 | B-1 | 50 | — | — | — | — | — | — |
| Reference example 31 | A-6 | 50 | B-1 | 49 | C-1 | 1 | — | — | — | — |
| Reference example 32 | A-6 | 50 | B-1 | 49 | — | — | D-1 | 1 | — | — |
| Reference example 33 | A-6 | 50 | B-1 | 49 | — | — | — | — | E-1 | 1 |
| Reference example 34 | A-6 | 50 | B-1 | 50 | — | — | — | — | — | — |
| Reference example 35 | A-7 | 50 | B-1 | 49 | C-1 | 1 | — | — | — | — |
| Reference example 36 | A-7 | 50 | B-1 | 49 | — | — | D-1 | 1 | — | — |
| Reference example 37 | A-7 | 50 | B-1 | 49 | — | — | — | — | E-1 | 1 |
| Reference example 38 | A-7 | 50 | B-1 | 50 | — | — | — | — | — | — |
| Reference example 39 | A-7 | 50 | B-1<br>B-3 | 45<br>5 | — | — | — | — | — | — |
| Comparative example 1 | ra-1 | 50 | B-1 | 50 | — | — | — | — | — | — |
| Comparative example 2 | ra-2 | 50 | B-1 | 50 | — | — | — | — | — | — |
| Comparative example 3 | ra-3 | 50 | B-1 | 50 | — | — | — | — | — | — |

TABLE 2-continued

| Category | Evaluation | | | | | | |
|---|---|---|---|---|---|---|---|
| | Yam yellowing | Swelling preventing | Shape | Running electricity | Scum | Cob-webbing preventing | Unwinding property |
| Example 1 | ○○ | ○ | ○○ | ○○ | ○○ | ○○ | ○○ |
| Example 2 | ○○ | ○ | ○○ | ○○ | ○○ | ○○ | ○○ |
| Example 3 | ○○ | ○ | ○○ | ○○ | ○○ | ○○ | ○○ |
| Example 4 | ○○ | ○ | ○○ | ○○ | ○○ | ○○ | ○○ |
| Example 5 | ○○ | ○ | ○○ | ○○ | ○○ | ○○ | ○○ |
| Example 6 | ○○ | ○ | ○○ | ○○ | ○○ | ○○ | ○○ |
| Example 7 | ○○ | ○ | ○○ | ○○ | ○○ | ○○ | ○○ |
| Example 8 | ○○ | ○ | ○○ | ○○ | ○○ | ○○ | ○○ |
| Example 9 | ○○ | ○ | ○○ | ○○ | ○○ | ○○ | ○○ |
| Example 10 | ○○ | ○ | ○○ | ○○ | ○○ | ○○ | ○○ |
| Example 11 | ○○ | ○ | ○○ | ○○ | ○○ | ○○ | ○○ |
| Example 12 | ○○ | ○ | ○○ | ○○ | ○○ | ○○ | ○○ |
| Example 13 | ○○ | ○ | ○○ | ○○ | ○○ | ○○ | ○○ |
| Example 14 | ○○ | ○ | ○○ | ○○ | ○○ | ○○ | ○○ |
| Example 15 | ○○ | ○ | ○○ | ○○ | ○○ | ○○ | ○○ |
| Example 16 | ○○ | ○ | ○○ | ○○ | ○○ | ○○ | ○○ |
| Example 17 | ○○ | ○ | ○○ | ○○ | ○○ | ○○ | ○○ |
| Example 18 | ○○ | ○ | ○○ | ○○ | ○○ | ○○ | ○○ |
| Example 19 | ○○ | ○ | ○○ | ○○ | ○○ | ○○ | ○○ |
| Reference example 20 | ○○ | ○ | ○○ | ○○ | ○○ | ○○ | ○○ |
| | | | ○○ | ○○ | ○○ | ○○ | ○○ |
| Reference example 21 | ○○ | ○ | ○ | ○○ | ○○ | ○○ | ○○ |
| Reference example 22 | ○ | ○ | ○○ | ○○ | ○○ | ○○ | ○○ |
| Reference example 23 | ○ | ○ | ○ | ○○ | ○○ | ○○ | ○○ |
| Example 24 | ○○ | ○ | ○○ | ○○ | ○○ | ○○ | ○ |
| Example 25 | ○○ | ○ | ○○ | ○○ | ○○ | ○ | ○ |
| Example 26 | ○○ | ○ | ○○ | ○ | ○○ | ○○ | ○○ |
| Example 27 | ○○ | ○ | ○○ | ○ | ○ | ○ | ○○ |
| Reference example 28 | ○○ | ○ | ○ | ○ | ○ | ○ | ○○ |
| Example 29 | ○○ | ○ | ○○ | ○ | ○ | ○ | ○ |
| Reference example 30 | ○○ | ○ | ○ | ○ | ○ | ○ | ○ |
| Reference example 31 | ○ | ○ | ○○ | ○○ | ○ | ○ | ○ |
| Reference example 32 | ○ | ○ | ○○ | ○ | ○○ | ○ | ○ |
| Reference example 33 | ○ | ○ | ○○ | ○ | ○ | ○○ | ○○ |
| Reference example 34 | ○ | ○ | ○○ | ○ | ○ | ○ | ○ |
| Reference example 35 | ○ | ○ | ○ | ○○ | ○ | ○ | ○ |
| Reference example 36 | ○ | ○ | ○ | ○ | ○○ | ○ | ○ |
| Reference example 37 | ○ | ○ | ○ | ○ | ○ | ○○ | ○○ |
| Reference example 38 | ○ | ○ | ○ | ○ | ○ | ○ | ○ |
| Reference example 39 | ○ | ○ | ○ | ○ | ○ | ○ | ○ |
| Comparative example 1 | x | x | x | x | x | x | x |
| Comparative example 2 | x | x | x | x | x | o | x |
| Comparative example 3 | ○ | ○ | x | ○ | ○ | x | ○ |

Details of B-1 to -3, C-1 and -2, D-1 to -3, and E-1 to -3 indicated in Table 2 are as follows.

B-1: dimethyl silicone with a viscosity at 25° C. of 10 cst ($mm^2/s$)

B-2: dimethyl silicone with a viscosity at 25° C. of 20 cst ($mm^2/s$)

B-3: isotridecyl stearate

C-1: sodium dilauryl sulfosuccinate

C-2: magnesium dioctyl sulfosuccinate

D-1: 2-hexyl-1-decanol

D-2: 2-(1,3,3-trimethylbutyl)-5,7,7-trimethyl-1-octanol

D-3: compound with 3 moles of ethylene oxide added to 1 mole of dodecanol

E-1: magnesium salt of 2-octyl-1-dodecyl phosphoric acid ester

E-2: magnesium salt of 2-hexyl-1-decyl phosphoric acid ester

E-3: dibutylethanolamine salt of 2-octyl-1-dodecyl phosphoric acid ester

Experimental Part 2 (Manufacture of Elastic Fibers)

A prepolymer obtained from a polytetramethylene glycol with a molecular weight of 1000 and diphenylmethane diisocyanate was made to undergo a chain extension reaction by ethylenediamine in a dimethylformamide solution to obtain a spinning dope of 30% concentration. The spinning dope was dry spun in a heated gas flow from a spinneret. The treatment agent was then neat-fed by a roller lubrication method onto the dry-spun polyurethane elastic fibers by a lubrication roller positioned between stretching rollers prior to winding.

The elastic fibers that have thus been roller-lubricated were wound, using a surface-driven winder, around a cylindrical paper tube of 58 mm length at a winding speed of 600 m/minute via a traverse guide that realizes a winding width of 38 mm to obtain a 500 g package of the dry-spun polyurethane elastic fibers of 40 denier. The adhesion amount of the elastic fiber treatment agent was adjusted to be 5% in all cases by adjusting a rotation speed of the lubrication roller.

Using the treatment agents, the elastic fibers, or the packages of roller-lubricated, dry-spun polyurethane elastic fibers thus obtained, the yarn yellowing suppression, swelling preventing property, shape characteristic, running electricity, scum formation suppression, cob-webbing preventing property, and unwinding property of the elastic fibers were evaluated as described below.

Experimental Part 3 (Evaluation of Treatment Agents and Elastic Fibers)

Evaluation of Yarn Yellowing Suppression

Each of the packages (500 g winding) with the respective treatment agents adhered thereto was subject to measurement of a b value of an end surface portion thereof by a color difference meter (color difference meter manufactured by MINOLTA: CR-300) and thereafter stored for 1 week while being irradiated with ultraviolet rays by an ultraviolet irradiator. With each of the packages after storage, the b value of the same end surface portion measured prior to ultraviolet irradiation was measured by the abovementioned color difference meter. Evaluation by criteria indicated below was performed based on a difference in b value before and after the 1-week storage under ultraviolet rays and the results are indicated in the "Yarn yellowing" column of Table 2.

○○ (good): The difference in b value was less than 0.6.

○ (fair): The difference in b value was not less than 0.6 but less than 1.

x (poor): The difference in b value was not less than 1.

Evaluation of Swelling Preventing Property

A sample constituted of a polyurethane film of square shape with a thickness of 1 mm and with each side being 20 mm was prepared and its mass (mass A before treatment) was measured. The sample was immersed in 100 mL of a treatment agent prepared in Experimental Part 1 at 40° C. for 1 week. Thereafter, the sample was taken out and after wiping off the treatment agent adhered to the sample, its mass (mass B after treatment) was measured. A mass change rate of the sample before and after the treatment of immersing in the treatment agent was determined by a formula indicated below. The swelling preventing property was then evaluated by criteria indicated below. The results are indicated in the "Swelling preventing property" column of Table 2.

$$\text{Mass change rate (\%)}=\{(B-A)/A\}\times 100$$

○ (fair): The mass change rate was less than 4%.

x (poor): The mass change rate was not less than 4%.

Evaluation of Shape Characteristic

Each treatment agent prepared in Experimental Part 1 was adhered at 7.0% to dry-spun polyurethane elastic fibers of 40 denier by the roller lubrication method. A package of the polyurethane elastic fibers was then obtained by using a surface-driven winder to wind 500 g around a cylindrical paper tube of 57 mm length at a winding speed of 550 m/minute via a traverse guide that realizes a winding width of 42 mm.

A maximum value (Wmax) and a minimum width (Wmin) of the winding width of the yarn package (500 g winding) was measured, and a bulge was determined from a difference between the two (Wmax−Wmin) and evaluated by criteria indicated below. The results are indicated in the "Shape" column of Table 2.

○○ (good): The bulge was less than 3 mm.

○ (fair): The bulge was not less than 3 mm but less than 6 mm.

X (poor): The bulge was not less than 6 mm.

Evaluation of Running Electricity

A chrome-plated textured pin with a diameter of 1 cm and a surface roughness of 2S was disposed between two free rollers, and polyurethane elastic fibers led out from a yarn package were arranged such as to be 90 degrees in contact angle with respect to the chrome-plated textured pin. An electrostatic potentiometer (tradename KSD-0103 manufactured by Kasuga Denki, Inc.) was disposed at a position 1 cm below the chrome-plated textured pin, and electricity generated when feeding at a speed of 50 m/minute and winding at a speed of 100 m/minute were performed under conditions of 25° C. and 65% RH was measured and evaluated by criteria indicated below. The results are shown in the "Running electricity" columns of Table 2.

○○ (good): The generated electricity was less than 50 volts (operation can be performed stably without any problem at all).

○ (fair): The generated electricity was not less than 50 volts but less than 100 volts (although gathering occurs slightly in a warping step, operation can be performed stably without problem).

x (poor): The generated electricity was not less than 100 volts (gathering of yarn occurs in the warping step, causing a problem in operation).

Evaluation of Scum Formation Suppression

Ten of the dry-spun polyurethane elastic fiber packages immediately after spinning were set in a miniature warping machine and 1500 km were wound at a yarn speed of 300 m/minute under an atmosphere of 25° C. and 65% RH. In this process, shedding and accumulation conditions of scum at a comb guide of the miniature warping machine were visually observed and evaluated by criteria indicated below. The results are indicated in the "Scum" column of Table 2.

○○ (good): There was hardly any deposition of scum.

○ (fair): Although there was some deposition of scum, there was no problem in stable running of the yarn.

x (poor): There was much deposition and accumulation of scum, presenting a major problem in the stable running of the yarn.

Evaluation of Cob-Webbing Preventing Property

The number of times yarn breakage occurred due to cob-webbing of the obtained dry-spun polyurethane elastic fiber package (500 g winding) immediately after spinning when 1000 m of the package were wound at a delivery speed of 20 m/minute and a winding speed of 40 m/minute was evaluated by criteria indicated below. The results are shown in the "Cob-webbing preventing property" column of Table 2.

○○ (good): Yarn breakage due to cob-webbing occurred 0 times.

○ (fair): Yarn breakage due to cob-webbing occurred not less than 1 time but less than 3 times.

x (poor): Yarn breakage due to cob-webbing occurred not less than 3 times.

Evaluation of Unwinding Property

A delivery portion was arranged at one side with a first drive roller and a first free roller in constant contact therewith, and a winding portion was also arranged at an opposite side with a second drive roller and a second free roller in constant contact therewith. The winding portion was installed 20 cm away in the horizontal direction from the delivery portion. The obtained dry-spun polyurethane elastic fiber package immediately after spinning was mounted onto the first drive roller, unwound until the thickness of the yarn winding reached 2 mm, and wound around the second drive roller. While keeping the delivery speed of the polyurethane elastic fibers from the first drive roller fixed at 50 m/minute, the winding speed of the polyurethane elastic fibers around the second drive roller was gradually increased from 50 m/minute to forcibly unwind the polyurethane elastic fibers from the package. During this forcible unwinding, the winding speed V (m/minute) at the time when swaying of the polyurethane elastic fibers no longer occurs between the delivery portion and the winding portion was measured. The unwinding property (%) was determined by a formula indicated below and evaluated by criteria indicated below. The results are indicated in the "Unwinding property" column of Table 2.

$$\text{Unwinding property (\%)}=(V-50)\times 2$$

○○ (good): The winding property was less than 120% (unwinding can be performed stably without any problem at all).

○ (fair): The unwinding property was not less than 120% but less than 180% (although there is some resistance against drawing out of the yarn, there is no occurrence of yarn breakage and unwinding can be performed stably).

x (poor): The unwinding property was not less than 180% (there is resistance against drawing out of the yarn and yarn breakage occurs such that there is a problem in operation).

As is clear from the evaluation results of the respective examples relative to the respective comparative examples in Table 2, the treatment agent of the present invention can improve the shape characteristics of the elastic fiber to which the treatment agent is applied. In addition, the effect of suppression of yarn yellowing, the swelling preventing property, the antistatic property, the scum suppression effect, the cob-webbing preventing effect, and the unwinding property are improved.

The present invention also encompasses the following embodiments.

Additional Embodiment 1

An elastic fiber treatment agent comprising, as a smoothing agent, a mineral oil with a content ratio of an aromatic component of less than 3% by mass and an aniline point of 70° C. to 110° C.

Additional Embodiment 2

The elastic fiber treatment agent according to additional embodiment 1, wherein the content ratio of the aromatic component in the mineral oil is less than 1% by mass.

Additional Embodiment 3

The elastic fiber treatment agent according to additional embodiment 1 or 2, wherein the mineral oil has a mass ratio between the content of a naphthene component and the content of a paraffin component of such that naphthene component/paraffin component=30 to 50/70 to 50.

Additional Embodiment 4

The elastic fiber treatment agent according to any one of additional embodiments 1 to 3, further comprising a dialkyl sulfosuccinic acid salt.

Additional Embodiment 5

The elastic fiber treatment agent according to any one of additional embodiments 1 to 4, further comprising at least one hydroxy compound selected from the group consisting of higher alcohols and alkylene oxide adducts of higher alcohols.

Additional Embodiment 6

The elastic fiber treatment agent according to additional embodiment 5, wherein the higher alcohol includes a monohydric aliphatic alcohol having a branched chain at a β-position of an alkyl chain with 10 to 20 carbon atoms.

Additional Embodiment 7

The elastic fiber treatment agent according to any one of additional embodiments 1 to 6, further comprising an alkyl phosphoric acid ester salt.

Additional Embodiment 8

The elastic fiber treatment agent according to additional embodiment 7, wherein the alkyl phosphoric acid ester salt is a magnesium salt of an alkyl phosphoric acid ester.

Additional Embodiment 9

The elastic fiber treatment agent according to any one of additional embodiments 1 to 8, wherein the content ratio of the mineral oil in the treatment agent is not less than 10% by mass.

Additional Embodiment 10

An elastic fiber comprising the elastic fiber treatment agent according to any one of additional embodiments 1 to 9 adhered thereto.

The invention claimed is:

1. An elastic fiber treatment agent comprising, a dialkyl sulfosuccinic acid salt; and as a smoothing agent, a mineral oil with a content ratio of an aromatic component of less than 1% by mass and an aniline point of 70° C. to 110° C., wherein the mineral oil has a mass ratio between the content of a naphthene component and the content of a paraffin component of such that naphthene component/paraffin component=30 to 50/70 to 50.

2. The elastic fiber treatment agent according to claim 1, wherein the content ratio of the mineral oil in the treatment agent is not less than 10% by mass.

3. The elastic fiber treatment agent according to claim 1, further comprising at least one hydroxy compound selected from the group consisting of higher alcohols and alkylene oxide adducts of higher alcohols.

4. The elastic fiber treatment agent according to claim 3, further comprising an alkyl phosphoric acid ester salt.

5. The elastic fiber treatment agent according to claim 1, further comprising an alkyl phosphoric acid ester salt.

6. An elastic fiber treatment agent comprising:

at least one hydroxy compound selected from the group consisting of higher alcohols and alkylene oxide adducts of higher alcohols; and as a smoothing agent, a mineral oil with a content ratio of an aromatic component of less than 1% by mass and an aniline point of 70° C. to 110° C., wherein the mineral oil has a mass ratio between the content of a naphthene component and the content of a paraffin component of such that naphthene component/paraffin component=30 to 50/70 to 50.

7. The elastic fiber treatment agent according to claim 6, wherein the higher alcohol includes a monohydric aliphatic alcohol having a branched chain at a β-position of an alkyl chain with 10 to 20 carbon atoms.

8. The elastic fiber treatment agent according to claim 6, further comprising an alkyl phosphoric acid ester salt.

9. The elastic fiber treatment agent according to claim 6, wherein the content ratio of the mineral oil in the treatment agent is not less than 10% by mass.

10. An elastic fiber treatment agent comprising:

an alkyl phosphoric acid ester salt; and as a smoothing agent, a mineral oil with a content ratio of an aromatic component of less than 1% by mass and an aniline point of 70° C. to 110° C., wherein the mineral oil has a mass ratio between the content of a naphthene component and the content of a paraffin component of such that naphthene component/paraffin component=30 to 50/70 to 50.

11. The elastic fiber treatment agent according to claim 10, wherein the alkyl phosphoric acid ester salt is a magnesium salt of an alkyl phosphoric acid ester.

12. The elastic fiber treatment agent according to claim 10, wherein the content ratio of the mineral oil in the treatment agent is not less than 10% by mass.

13. An elastic fiber comprising an elastic fiber treatment agent adhered thereto, wherein the elastic fiber treatment agent contains, as a smoothing agent, a mineral oil with a content ratio of an aromatic component of less than 1% by mass and an aniline point of 70° C. to 110° C., wherein the mineral oil has a mass ratio between the content of a naphthene component and the content of a paraffin component of such that naphthene component/paraffin component=30 to 50/70 to 50.

* * * * *